US009060662B2

(12) United States Patent
Seo et al.

(10) Patent No.: US 9,060,662 B2
(45) Date of Patent: Jun. 23, 2015

(54) UPRIGHT TYPE VACUUM CLEANER

(75) Inventors: Jin Wook Seo, Anyang-si (KR); Sang Jun Park, Anyang-si (KR)

(73) Assignee: LG ELECTRONICS INC., Seoul (KR)

( * ) Notice: Subject to any disclaimer, the term of this patent is extended or adjusted under 35 U.S.C. 154(b) by 641 days.

(21) Appl. No.: 13/205,421

(22) Filed: Aug. 8, 2011

(65) Prior Publication Data

US 2012/0030900 A1 Feb. 9, 2012

(30) Foreign Application Priority Data

Aug. 9, 2010 (KR) ..... 10-2010-0076303

(51) Int. Cl.
*A47L 5/28* (2006.01)
*A47L 9/00* (2006.01)

(52) U.S. Cl.
CPC ..... *A47L 5/28* (2013.01); *A47L 9/0054* (2013.01); *A47L 9/009* (2013.01)

(58) Field of Classification Search
CPC ..... A47L 9/009; A47L 5/28; A47L 9/242; A47L 9/02; A47L 5/00
USPC ..... 15/410, 411, 350, 351, 352, 354, 336, 15/363
See application file for complete search history.

(56) References Cited

U.S. PATENT DOCUMENTS

| | | | | |
|---|---|---|---|---|
| 5,911,261 | A * | 6/1999 | Farone et al. | 15/416 |
| 8,656,552 | B2 * | 2/2014 | Vines et al. | 15/410 |
| 2008/0115313 | A1 * | 5/2008 | Dyson et al. | 15/336 |
| 2009/0165242 | A1 * | 7/2009 | Lee et al. | 15/411 |

FOREIGN PATENT DOCUMENTS

| | | | |
|---|---|---|---|
| JP | 11-178756 | A | 7/1999 |
| JP | 2003-102663 | A | 4/2003 |
| WO | WO 2009/125185 | A1 | 10/2009 |

* cited by examiner

*Primary Examiner* — Robert Scruggs
(74) *Attorney, Agent, or Firm* — Birch, Stewart, Kolasch & Birch, LLP

(57) ABSTRACT

An upright type vacuum cleaner is disclosed. The upright type vacuum cleaner includes a main body provided so that a disposition angle of the main body with respect to a surface to be cleaned is variable, a suction nozzle coupled to the main body so that the suction nozzle moves along the surface to be cleaned, and a joint provided between the main body and the suction nozzle to connect the main body and the suction nozzle so that the main body and the suction nozzle are rotated about a plurality of axes.

14 Claims, 9 Drawing Sheets

UPRIGHT TYPE VACUUM CLEANER

Pursuant to 35 U.S.C. §119(a), This application claims the benefit of Korean Patent Application No. 10-2010-0076303, filed on Aug. 9, 2010, which is hereby incorporated by reference as if fully set forth herein.

BACKGROUND OF THE INVENTION

1. Field of the Invention

The present invention relates to an upright type vacuum cleaner, and more particularly, to an upright type vacuum cleaner wherein the steering performance of the upright type vacuum cleaner is improved, load pressure applied to the upright type vacuum cleaner is dispersed, thereby improving user convenience during cleaning.

2. Discussion of the Related Art

Generally, a vacuum cleaner is a device that suctions dust and foreign matter together with air using a suction motor mounted in a main body and filters the dust and foreign in the main body.

A vacuum cleaner having the aforementioned function may be classified as an upright type vacuum cleaner in which a suction port, i.e. a suction nozzle, is integrated with a main body or a canister type vacuum cleaner in which a suction nozzle is connected to a main body via a connection pipe.

Of the above two vacuum cleaners, the upright type vacuum cleaner includes a main body having a suction motor to generate suction force mounted therein, a suction nozzle to suction dust and foreign matter from a surface to be cleaned into the main body of the vacuum cleaner using the suction force generated by the suction motor, and a grip provided at the upper part of the main body of the vacuum cleaner so that a user moves the suction nozzle along the surface to be cleaned while holding the grip.

That is, when the suction motor is driven by power supplied to the main body, suction force is generated by the suction motor, and air containing dust and foreign matter is suctioned into the suction nozzle by the suction force.

Subsequently, the air containing dust and foreign matter is introduced into the main body of the vacuum cleaner. In a dust collection box mounted in the main body, the dust and foreign matter are separated from the air according to the principle of cyclone.

The separated dust and foreign matter are collected in the dust collection box, and the air, from which the dust and foreign matter have been separated, is discharged from the main body through an air discharge port.

In the upright type vacuum cleaner with the above-stated construction, however, the main body is located at the upper part of the suction nozzle with the result that load pressure of the main body is directly applied to the suction nozzle. Consequently, the steering performance of the main body is lowered.

Also, in the upright type vacuum cleaner with the above-stated construction, the suction nozzle is integrated with the main body with the result that, during cleaning, load pressure of the main body rotated at a predetermined angle is applied to a user. Consequently, the user may easily feel fatigue.

In addition, the dust collection box and the suction motor are mounted in the main body with the result that the user must support the load of the main body using his/her arm. Consequently, it is difficult for the user to perform cleaning for a long period of time.

SUMMARY OF THE INVENTION

Accordingly, the present invention is directed to an upright type vacuum cleaner that substantially obviates one or more problems due to limitations and disadvantages of the related art.

An object of the present invention is to provide an upright type vacuum cleaner having a joint connected between a main body and a suction nozzle to improve the steering performance of the upright type vacuum cleaner and a support unit to support the main body, which is heavy, so that a user can easily perform cleaning for a long period of time.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an upright type vacuum cleaner includes a main body provided so that a disposition angle of the main body with respect to a surface to be cleaned is variable, a suction nozzle coupled to the main body so that the suction nozzle moves along the surface to be cleaned, and a joint provided between the main body and the suction nozzle to connect the main body and the suction nozzle so that the main body and the suction nozzle are rotated about a plurality of axes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
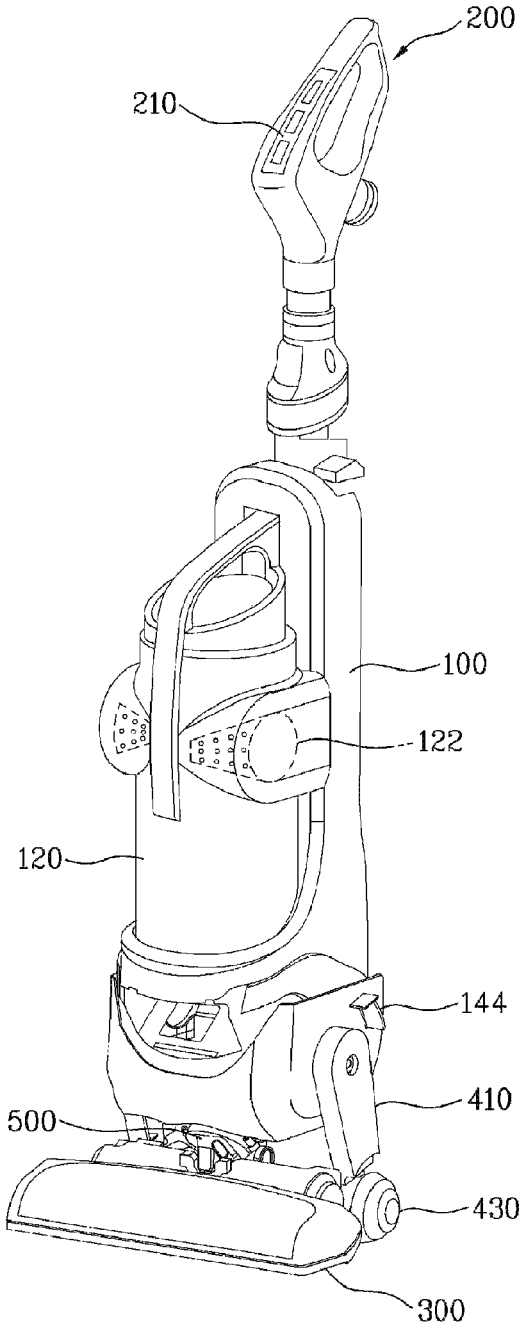
FIG. 1 is a perspective view showing the front of an upright type vacuum cleaner according to an embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

In the drawings, sizes and shapes of elements may be exaggerated for convenience and clarity of description. Also, terms specially defined in consideration of the construction and operation of the present invention may vary depending upon intensions of users or operators or usual practices. The definition of such terms must be made based on the disclosure of the present invention.

Furthermore, an idea of the present invention is not limited to embodiments which will be illustrated hereinafter. It may be possible for those skilled in the art who understand the idea of the present invention to easily derive other different embodiments from the disclosure of the present invention within the scope of the same idea, which, of course, fall into the scope of the present invention.

FIG. 1 is a perspective view showing the front of an upright type vacuum cleaner according to an embodiment of the present invention. The construction and operation of the upright type vacuum cleaner according to the embodiment of the present invention will be described in detail with reference to FIG. 1.

The upright type vacuum cleaner shown in FIG. 1 includes a main body 100 in which a duct collection box 120 to collect dust and foreign matter from a surface to be cleaned is mounted, a suction nozzle 300 provided at the lower side of the main body 100 so that the main body 100 is located at the suction nozzle 300 to suction dust and foreign matter from the surface to be cleaned together with air, a grip provided at the upper side of the main body 100 to allow a user to hold the grip so as to perform cleaning and a joint 500 connected between the main body 100 and the suction nozzle 300.

The main body 100 is located at the upper side of the suction nozzle 300 so that the main body 100 can be rotatably coupled to the suction nozzle 300 and thus the angle of the main body 100 with respect to the surface to be cleaned is variable. A user can support the main body 100 so that the main body 100 remains rotated toward the surface to be cleaned during cleaning.

The duct collection box 120 is detachably coupled to the front of the main body 100. The duct collection box 120 has a dust separation member 122 to filter dust and foreign matter from the air suctioned into the main body 100 according to the principle of cyclone.

That is, the air, suctioned into the main body 110 through the suction nozzle 300, is introduced into the dust collection box 120. Dust and foreign matter are filtered from the air introduced into the dust collection box 120 by the dust separation member 122 and are collected in the dust collection box 120. Clean air, from which the dust and foreign matter have been separated, is discharged from the main body 100.

Also, since the dust collection box 120 is detachably coupled to the main body 100, a user can easily separate the dust collection box 120 from the main body 100 when the user wishes to dump the dust and foreign manner collected in the dust collection box 120.

Meanwhile, the duct collection box 120 shown in FIG. 1 is configured in a cylindrical shape. Alternatively, the duct collection box 120 may be configured in a polygonal shape, such as a square shape. The present invention is not limited to the shape of the dust collection box 120.

The suction nozzle 300 suctions dust and foreign matter from a surface to be cleaned together with air. That is, when a user performs cleaning, the suction nozzle 300 moves back and forth and from side to side with respect to the surface to be cleaned so as to suction dust and foreign matter from the surface to be cleaned.

A moving wheel (not shown) may be rotatably provided at the bottom of the suction nozzle 300.

That is, when the suction nozzle 300 moves on the surface to be cleaned, the moving wheel is rotated so that the suction nozzle 300 can smoothly move along the surface to be cleaned.

Meanwhile, the grip 200 is provided at the upper side of the main body 100. During cleaning, therefore, a user can hold the grip 200 to support the main body 100 so that the main body 100 remains rotated at a predetermined angle.

A manipulation panel 210 is provided at the front of the grip 200. A user can press buttons provided at the manipulation panel 210 to manipulate the operation of the upright type vacuum cleaner according to the embodiment of the present invention.

For example, the user can adjust suction intensity, cleaning time or the like of the suction nozzle 300 based on the state of the surface to be cleaned, thereby improving user convenience.

Meanwhile, the joint 500 is provided between the main body 100 and the suction nozzle 300. The main body 100 and the suction nozzle 300 are connected to each other via the joint 500 so that the main body 100 can be rotated with respect to the suction nozzle 300.

Figure 2:
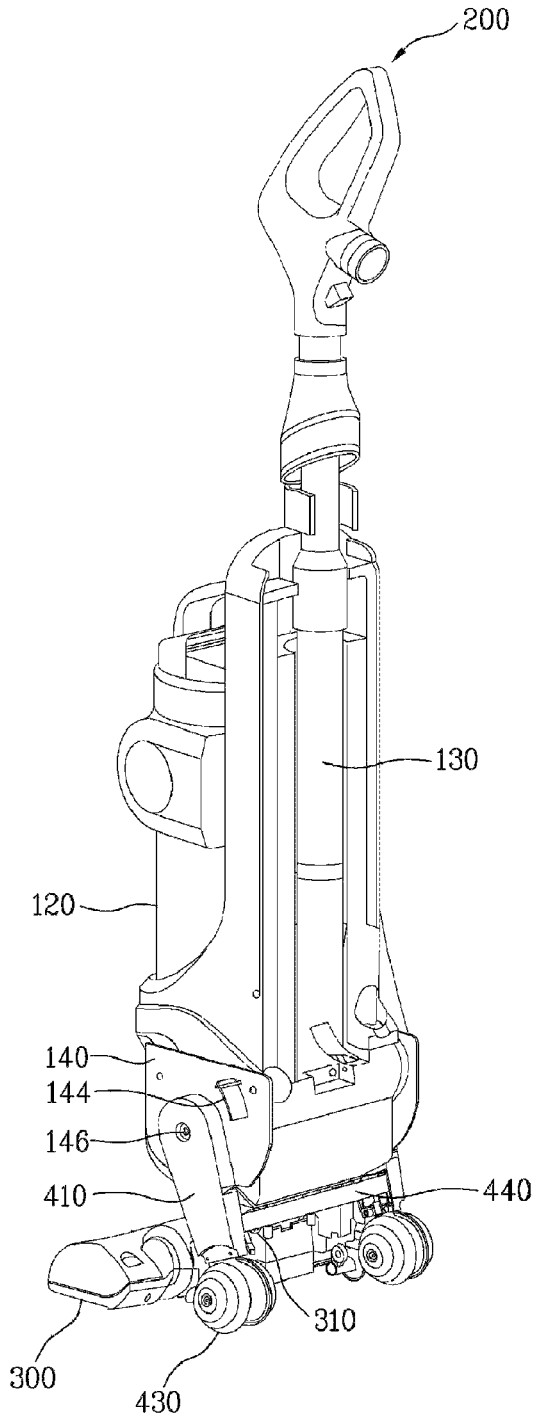
FIG. 2 is a perspective view showing the rear of the upright type vacuum cleaner according to the embodiment of the present invention.

FIG. 2 is a perspective view showing the rear of the upright type vacuum cleaner according to the embodiment of the present invention. The construction and operation of the upright type vacuum cleaner according to the embodiment of the present invention will be described in detail with reference to FIG. 2.

Meanwhile, a description of elements of the upright type vacuum cleaner shown in FIG. 2 identical to those of the upright type vacuum cleaner shown in FIG. 1 will be omitted.

As shown in FIG. 2, a motor installation part 110, in which a suction motor (not shown) is installed, is provided at the lower part of the rear of the upright type vacuum cleaner according to the embodiment of the present invention.

That is, the suction motor is installed in the motor installation part 110. When the suction motor is driven, suction force is generated to suction dust and foreign matter into the main body 100 through the suction nozzle 300 together with air.

The suctioned dust and foreign matter is filtered by the dust separation member 122 in the dust collection box 120.

Meanwhile, a suction pipe 130 is provided at the rear of the main body 100. The suction pipe 130 guides the air, from which the dust and foreign matters have been separated in the dust collection box 120, to the suction motor.

That is, air containing dust and foreign matter is suctioned into the dust collection box 120 through the suction nozzle 300 from the surface to be cleaned by suction force generated by the suction motor. The dust and foreign matter are separated from the air in the dust collection box 120. The clean air, from which the dust and foreign matter have been separated, is moved to the suction motor through the suction pipe 130 and is discharged from the main body 100.

Also, a support unit 400 includes a support part 410 provided at each side of the main body 100 so that the support part 410 can be rotatably coupled to the main body 100.

The upper end of the support part 410 is rotatably coupled to a coupling shaft 146 provided at each side of the main body 100. A wheel part 430 is coupled to the lower end of the support part 410 to support the main body 100 with respect to the surface to be cleaned so that the support part 410 can be maintained at an initial position.

That is, when a user stores the upright type vacuum cleaner according to the embodiment of the present invention, the support unit 400 supports the main body 100 so that the main body 100 remains upright, thereby reducing the volume of the vacuum cleaner and thus efficiently utilizing a receiving space.

Meanwhile, the support unit 400 further includes a fixing shaft 440 connected between the support parts 410, provided at opposite sides of the main body 100. Opposite ends of the fixing shaft 440 are coupled to the respective support parts 410 to uniformly maintain the distance between the support parts 410, thereby improving stability when the main body 100 is supported by the support unit 400.

Figure 3:
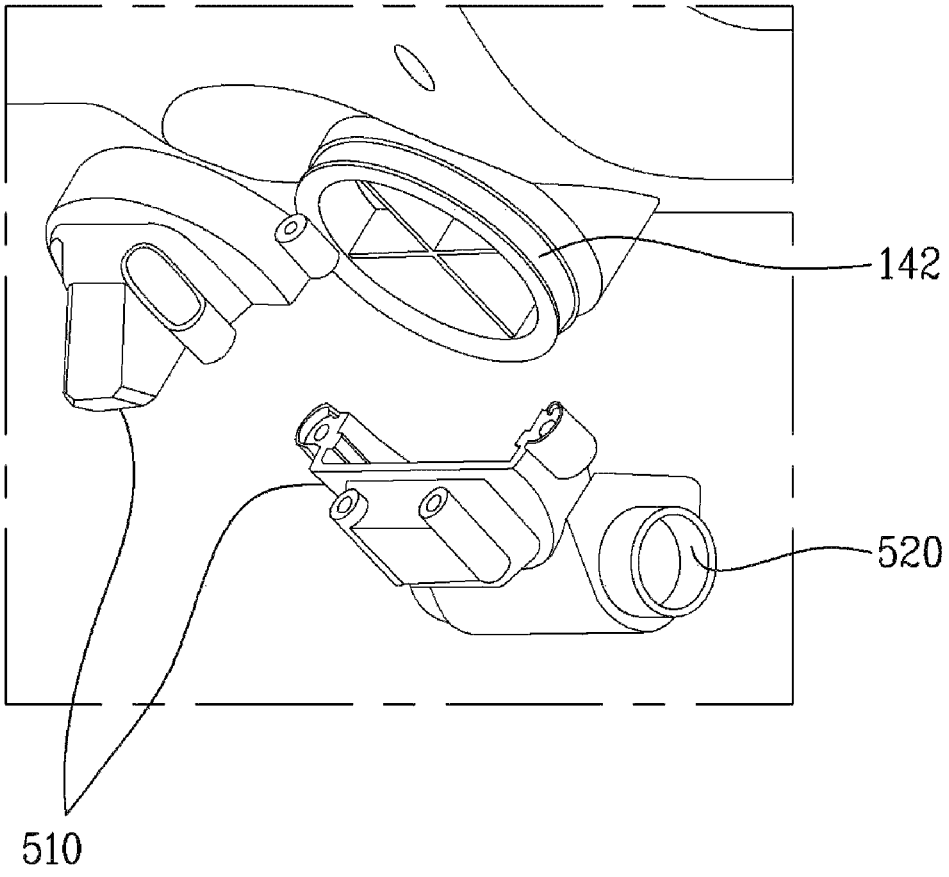
FIG. 3 is an exploded perspective view showing a joint of the upright type vacuum cleaner according to the embodiment of the present invention.

FIG. 3 is an exploded perspective view showing the joint 500 of the upright type vacuum cleaner according to the embodiment of the present invention. The structure of the joint 500 will be described in detail with reference to FIG. 3.

As shown in FIG. 3, a first connection part 142 is provided at the lower part of the main body 100. The first connection part 142 is configured in the shape of a cylinder extending a predetermined length from the lower part of the main body 100 toward the suction nozzle 300.

The joint 500, connecting the main body 100 and the suction nozzle 300 to each other, is provided between the main body 100 and the suction nozzle. That is, the joint 500 includes a first joint member 510, to which the main body 100 is coupled, and a second joint member 520, to which the suction nozzle 300 is coupled.

The interior of the first joint member 510 is configured in a shape corresponding to the shape of one end of the first connection part 142 so that the interior of the first joint member 510 can be coupled to the end of the first connection part 142. That is, the first joint member 510 is configured in the shape of a cylinder having a predetermined height.

As shown in FIG. 3, the first joint member 510, before assembly thereof, includes first joint member parts separated from each other about the diameter of the bottom of the first joint member 510 so that the first joint member 510 can be easily coupled to the first connection part 142. The first joint member parts are assembled so that the first joint member 510 can be coupled to the first connection part 142 by coupling members (not shown).

Also, a bearing (not shown) may be provided between the first connection part 142 and the first joint member 510 so that the main body 100 can be smoothly rotated.

Meanwhile, the second joint member 520 is provided at one side of the first joint member 510. That is, the second joint member 520 is coupled to a second connection part 310 provided at the suction nozzle 300 so that the main body 100 and the suction nozzle 300 can be connected to each other.

Figure 4:
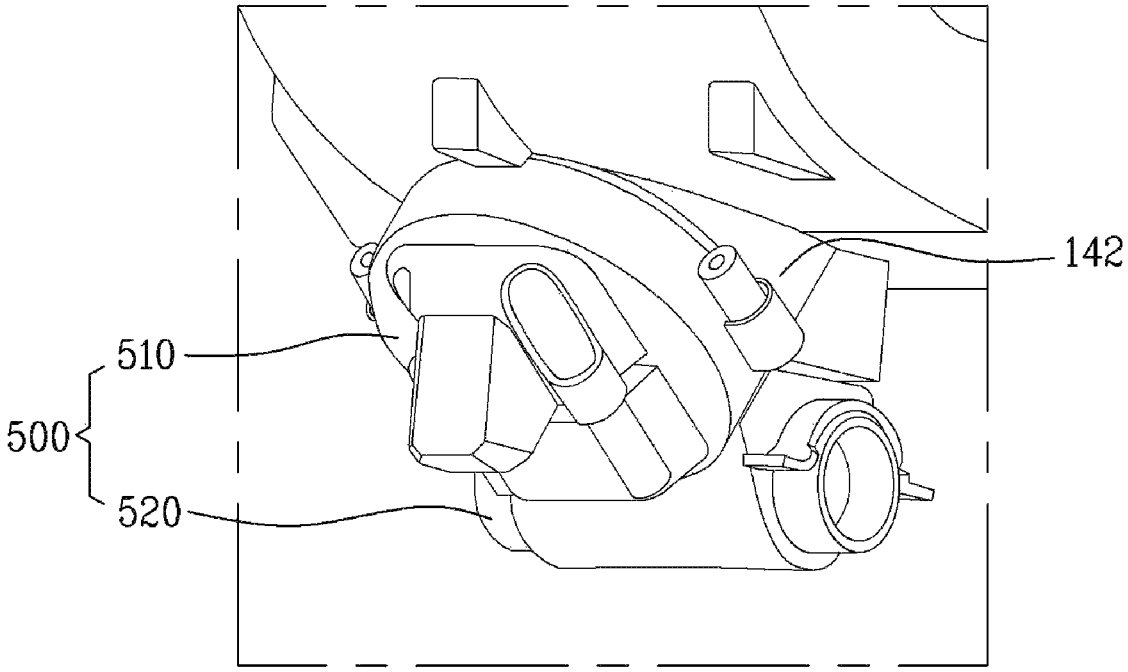
FIG. 4 is a perspective view showing the coupling between a first connection part and the joint of the upright type vacuum cleaner according to the embodiment of the present invention.

FIG. 4 is a perspective view showing the coupling between the first connection part 142 and the joint 500 of the upright type vacuum cleaner according to the embodiment of the present invention. The operation of the joint 500 will be described in detail with reference to FIG. 4.

As previously described, the first joint member parts of the first joint member 510 separated from each other about the diameter of the bottom of the first joint member 510 are assembled so that the first joint member 510 can be coupled to the first connection part 142 by the coupling.

Consequently, the main body 100 is rotated about a first axis, which is the center of the first connection part 142. The bearing is disposed between the first connection part 142 of the main body 100 and the first joint member 510 so that the main body 100 can be smoothly rotated about the first axis.

Here, the first axis is a central axis about which the main body 100 is rotated with respect to the suction nozzle 300 to the left and to the right.

That is, the main body 100 can be rotated about the first axis in a state in which the main body 100 remains upright.

Meanwhile, the second joint member 520, provided at one side of the first joint member 510, is rotatably coupled to the second connection part 310 so that the main body 100 can be rotated about a second axis.

Here, the second axis is an axis about which the main body 100 is rotated in the direction perpendicular to the first axis. A bearing (not show) is also provided between the second joint member 520 and the second connection part 310 so that the main body 100 can be smoothly rotated about the second axis.

That is, the main body 100 can be rotated about the second axis in a state in which the main body 100 remains upright, and therefore, the main body 100 can be rotated toward the surface to be cleaned.

In conclusion, the main body 100 can be rotated with respect to the suction nozzle 300 about the first axis and the second axis perpendicular to the first axis. Consequently, the steering performance of the main body 100 is improved.

Here, the second axis is a central axis about which the main body 100 is rotated with respect to the suction nozzle 300 upward and downward.

That is, although the main body 100 is located at the upper side of the suction nozzle 300, the main body 100 can be rotated about the two axes. Consequently, steering performance of the main body 100 is improved, and therefore, user convenience is improved.

Figure 5:
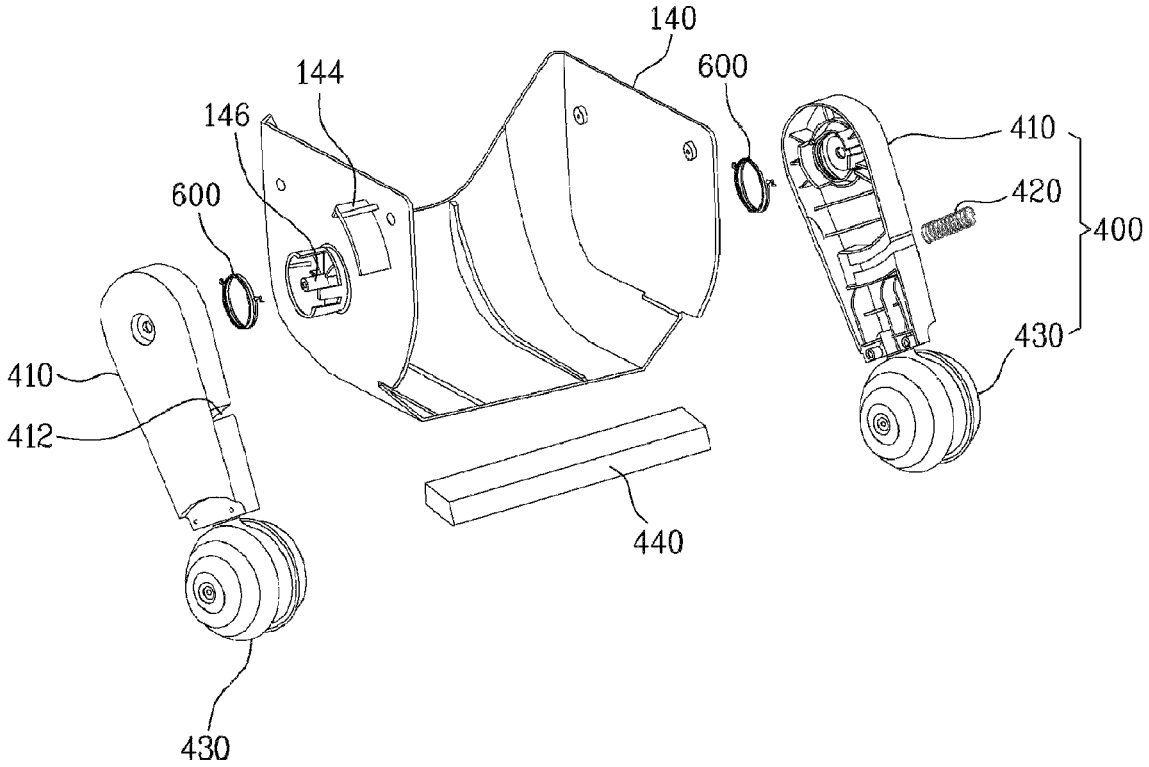
FIG. 5 is an exploded perspective view showing a support unit of the upright type vacuum cleaner according to the embodiment of the present invention.

FIG. 5 is an exploded perspective view showing the support unit 400 of the upright type vacuum cleaner according to the embodiment of the present invention. The construction and operation of the support unit 400 to support the main body 100 will be described in detail with reference to FIG. 5.

The main body 100 includes a cover 140 to protect the lower part of the main body 100. The cover 140 is configured to cover a portion of the lower part of the main body 100.

The support unit 400 to support the main body 100 is coupled to each side of the cover 140. That is, a coupling shaft 146 is formed at each side of the cover 140 in a protruding fashion. The support unit 400 is rotatably coupled to the coupling shaft 146.

When the main body 100 remains upright, therefore, the support unit 400 is maintained at an initial position to support the main body 100. When the main body 100 is rotated toward a surface to be cleaned at a predetermined angle, on the other hand, the support unit 400 is maintained at an operating position at which the rotated main body 100 is supported to disperse load applied to the main body 100.

Meanwhile, the support unit 400 includes a support part 410 and a wheel part 430. One end of the support part 410 is rotatably coupled to each side of the cover 140. The wheel part 430 is rotatably provided at the other end of the support part 410.

A support protrusion 144 is provided at the cover 140. When the main body 100 is rotated toward the surface to be cleaned at a predetermined angle, the support unit 400 supports the support protrusion 144 so that the operating position is maintained to support the main body 100.

Meanwhile, an insertion groove 412 is formed at the support part 410. The insertion groove 412 is formed at a position corresponding to the support protrusion in a state in which the operating position is maintained.

That is, when the support protrusion 144 is supported by the support unit 400, the support protrusion 144 is inserted into the insertion groove 412 to restrict the rotation of the main body 100 at the operating position.

Also, a first elastic member 420 is inserted into the insertion groove 412 in the longitudinal direction of the insertion groove 412. That is, the support protrusion 144, inserted into the insertion groove 412 at the operating position, elastically supports the main body 100 through the first elastic member 420.

Consequently, vibration generated from the main body 100, when the suction nozzle 300 passes obstacles on a surface to be cleaned, is absorbed by the first elastic member 420, and therefore, it is possible for a user to perform cleaning in a state in which the user easily supports the main body 100.

The first elastic member 420 may be a coil spring. The first elastic member 420 is inserted into the insertion groove 412 in the longitudinal direction thereof. One end of the first elastic member 420 supports the support protrusion 144 and the other end of the first elastic member 420 comes into contact with the inner surface of the support part 410 to absorb the vibration generated from the main body 100.

Meanwhile, a second elastic member 600 is provided between the other end of the support part 410 and the coupling shaft 146. That is, the second elastic member 600 is disposed between the support part 410 and the coupling shaft 146 to provide elastic force to the support part 410 so that the support unit 400 can be moved from the operating position to the initial position.

The second elastic member 600 may be a torsion spring.

Consequently, when a user moves the main body in a state in which the main body 100 remains upright after the user performs cleaning at the operating position at which the support unit 400 supports the main body rotated toward a surface to be cleaned at a predetermined angle, the support unit 400 is rotated to the initial position at which the main body 100 is supported in a state in which the main body 100 remains upright by elastic force of the second elastic member 600.

The fixing shaft 440 is provided between the support parts 410. Opposite ends of the fixing shaft 440 are coupled to the respective support parts 410 to connect the support parts 410.

The fixing shaft 440 uniformly maintains the distance between the support parts 410 so that the support unit 400 can stably support the main body 100.

The wheel part 430, provided at the other end of each of the support parts 410, supports the main body 100 with respect to the surface to be cleaned and, at the same time, rotates to facilitate the movement of the main body. Hereinafter, the structure and operation of the wheel part 430 will be described.

Figure 6:
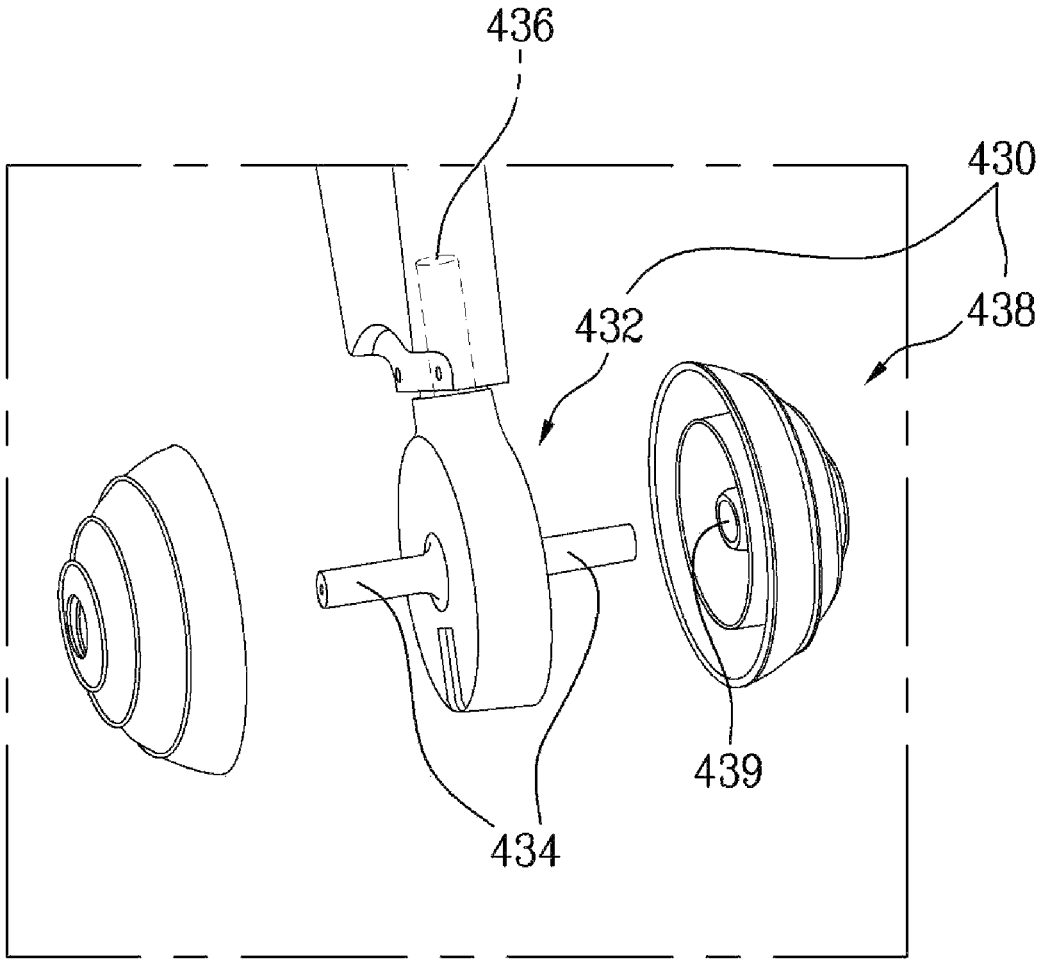
FIG. 6 is an exploded perspective view showing a wheel part of the upright type vacuum cleaner according to the embodiment of the present invention.

FIG. 6 is an exploded perspective view showing the wheel part 430 of the upright type vacuum cleaner according to the embodiment of the present invention. The construction and coupling relationship of the wheel part 430 will be described in detail with reference to FIG. 6.

As shown in FIG. 6, the wheel part 430 is provided at one end of the support part 410. The wheel part 430 includes a frame member 432 and a pair of roller members 438.

That is, the frame member 432 is a member that forms a frame of the wheel part 430. First rotation shafts 434 are formed at opposite sides of the frame member 432 in a protruding fashion. A first rotation shaft 436 is formed at the upper side of the frame member 432 in a protruding fashion.

The second rotation shaft 436 is rotatably coupled to one end of the support part 410 so that the wheel part 430 is coupled to the support part 410.

Meanwhile, the roller members 438 are provided at opposite sides of the frame member 432. Each of the roller members 438 is configured in a hemispherical shape. The surface of each of the roller members 438 coupled to the frame member 432 is open. Each of the roller members 438 is coupled to a corresponding one of the first rotation shafts 434 so that each of the roller members 438 can be rotated about the corresponding first rotation shaft 434.

That is, a hollow type boss 439 is provided in each of the hemispherical roller members 438. A corresponding one of the first rotation shafts 434 is inserted into the boss 439 so that the roller members 438 are coupled to the frame member 432.

Figure 7:
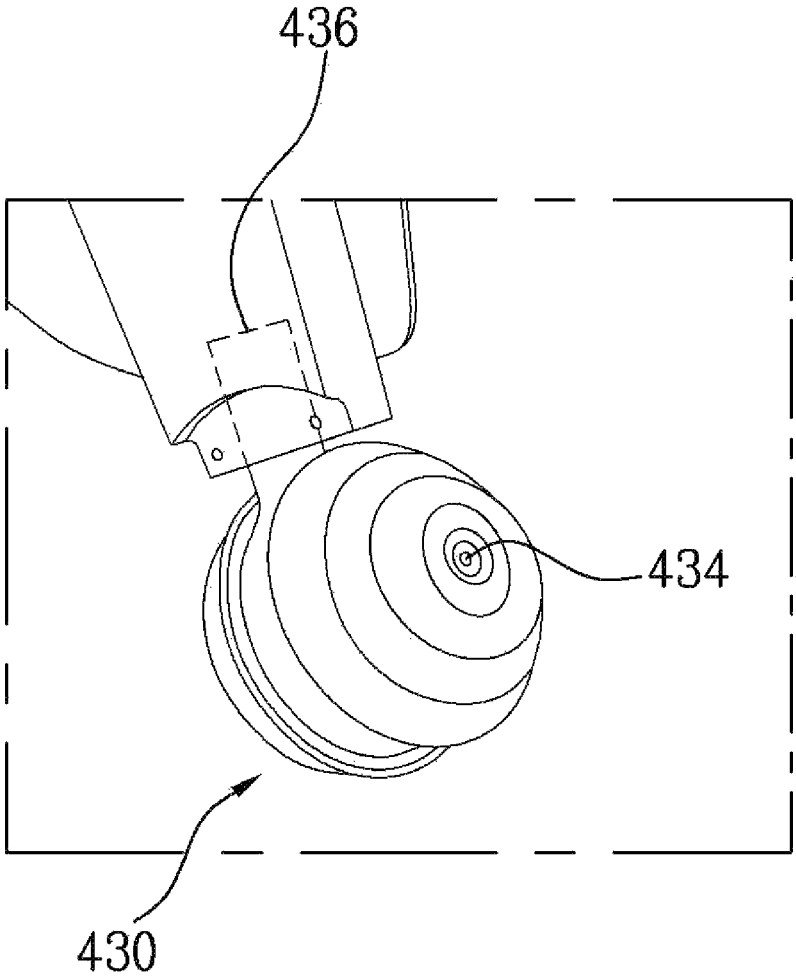
FIG. 7 is a perspective view showing the coupling between a support part and the wheel part of the upright type vacuum cleaner according to the embodiment of the present invention.

FIG. 7 is a perspective view showing the coupling between the support part 410 and the wheel part 430 of the upright type vacuum cleaner according to the embodiment of the present invention. The operation of the wheel part 430 coupled to one end of the support part 410 will be described in detail with reference to FIG. 7.

As previously described, the wheel part 430, including the frame member 432 coupled to one end of the support part and the roller members 438 coupled to the opposite sides of the frame member 432, supports the main body 100.

That is, the frame member 432 is rotated about the second rotation shaft 436 provided in the longitudinal direction of the support part 410, and the roller members 438 are rotated about the first rotation shafts 434 provided at the opposite sides of the frame member 432.

The roller members 438 are rotated about the first axis and the second axis, which is perpendicular to the first axis. Consequently, the steering performance of the roller members 438 is improved, and therefore, user convenience is improved.

Figure 8:
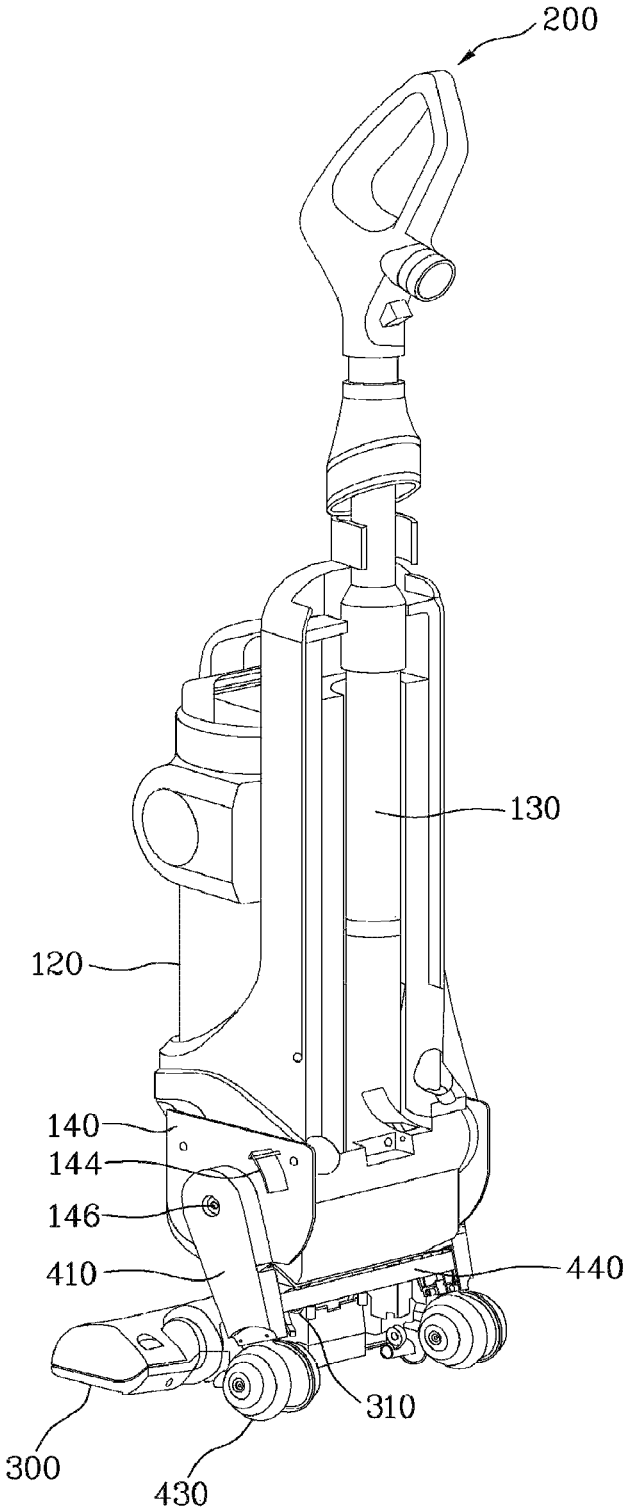
FIGS. 8 and 9 are perspective views showing the operation of the upright type vacuum cleaner according to the embodiment of the present invention.
Figure 9:
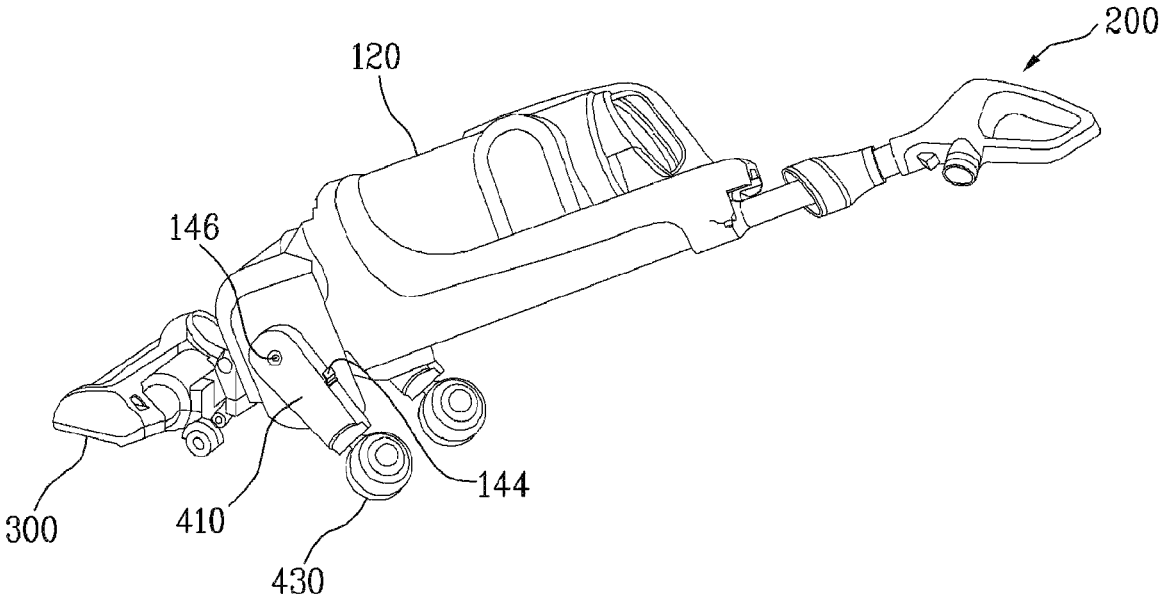

FIGS. 8 and 9 are perspective views showing the operation of the upright type vacuum cleaner according to the embodiment of the present invention. The operation of the upright type vacuum cleaner according to the embodiment of the present invention when a user performs cleaning using the cleaner will be described in detail with reference to FIGS. 8 and 9.

First, as shown in FIG. 8, when the user does not perform cleaning and thus the upright type vacuum cleaner is stored, the main body 100 is located at the upper side of the suction nozzle 300 in a state in which the main body 100 remains upright.

In this state, the support unit 400 is maintained at an initial position at which the support unit 400 supports the main body 100 in a state in which main body 100 remains upright. That is, the second elastic member 600 is disposed between the other end of the support part 410 and the coupling shaft 146, and the second elastic member 600 provides elastic force, by which the support unit 400 is maintained at the initial position.

On the other hand, when the user rotates the main body 100 toward a surface to be cleaned to perform cleaning, load of the main body is greater than the elastic force of the second elastic member 600 with the result that the main body 100 is rotated toward the surface to be cleaned and the support unit 400 is moved to an operating position at which the support unit 400 supports the main body 100.

When the support protrusions 144 provided at the opposite sides of the main body 100 are inserted into the insertion grooves 412 formed at the respective support parts 410, the rotation of the main body 100 is restricted, and therefore, the support unit 400 is maintained at the operating position.

Consequently, the support unit 400 supports the main body, while the user performs cleaning, to disperse load pressure of the main body 100, and therefore, it is possible for the user to easily perform cleaning for a long period of time and fatigue due to cleaning is greatly reduced.

Also, the first elastic members 420, to elastically support the support protrusions 144, are inserted into the respective insertion grooves 412. When the cleaner runs into obstacles present on the surface to be cleaned during movement of the cleaner on the surface to be cleaned, therefore, the first elastic members 420 absorbs vibration generated from the main body 100, thereby improving user convenience.

In addition, as previously described, the joint 500, provided between the main body 100 and the suction nozzle 300, and the wheel parts 430, provided at the corresponding ends of the support parts 410, can be rotated about two axes. Consequently, the steering performance of the cleaner is improved when cleaning is performed using the cleaner.

When the user finishes cleaning and stores the cleaner in a state in which the cleaner remains upright, the user can rotate the main body in a state in which the main body 100 remains upright using little force.

That is, the second elastic force 600 is disposed between the other end of each of the support parts 410 and a corresponding one of the coupling shafts 146 to provide elastic force, by which the support unit 400 is moved from the operating position to the initial position. Consequently, it is possible to user to rotate the main body in a state in which the main body 100 remains upright using little force.

As is apparent from the above description, the joint is provided to connect the main body and the suction nozzle so that the main body can be rotated with respect to the suction nozzle about two axes. Consequently, the present invention has the effect of improving the steering performance of the main body.

Also, when a user performs cleaning on a surface to be cleaned, the support unit provided at the main body supports the main body, in which the dust collection box and the suction motor are mounted, to disperse load pressure of the main body. Consequently, the present invention has the effect of enabling the user to easily perform cleaning for a long period of time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An upright type vacuum cleaner comprising:

a main body provided so that a disposition angle of the main body with respect to a surface to be cleaned is variable;

a suction nozzle coupled to the main body so that the suction nozzle moves along the surface to be cleaned; and a support unit provided at opposite sides of the main body to support the main body, wherein the support unit comprises:

support parts rotatably coupled to each side of the main body;

a wheel part rotatably provided at one end of the support parts; and a fixing shaft directly connected between the support parts without contacting the main body to uniformly maintain a distance between the support parts, wherein the support parts move the wheel parts farther relative to the suction nozzle when the cleaner is moved from a parked position to an operating position, wherein the main body is provided with a support protrusion, and the support unit supports the support protrusion at the operating position, wherein the support part has an insertion groove, in which the support protrusion is inserted, and a first elastic member inserted into the insertion groove to elastically support the main body at the operating position, and wherein an opening of the insertion groove is arranged to a surface of the support part opposite to the rotational direction of the support part.

2. The upright type vacuum cleaner according to claim 1, further comprising a joint provided between the main body and the suction nozzle to connect the main body and the suction nozzle so that the main body and the suction nozzle are rotated about a plurality of axes, wherein the joint comprises:

a first joint member coupled to a first connection part provided at a lower part of the main body so that the main body is rotated about a first axis; and a second joint member provided at one side of the first joint member, the second joint member being coupled to a second connection part provided at the suction nozzle so that the main body is rotated about a second axis perpendicular to the first axis.

3. The upright type vacuum cleaner according to claim 1, wherein when the main body being located at an upper part of the suction nozzle is rotated toward the surface to be cleaned at a predetermined angle, the support unit is moved from a predetermined initial position to an operating position at which the support unit supports the main body so as to disperse load pressure of the main body.

4. The upright type vacuum cleaner according to claim 1, wherein the first elastic member comprises a coil spring.

5. The upright type vacuum cleaner according to claim 1, wherein the wheel part comprises:

a frame member having first rotation shafts provided at opposite sides thereof and a second rotation shaft provided at an upper part thereof, the second rotation shaft being rotatably coupled to one end of the support part; and roller members rotatably coupled to the first rotation shafts, respectively.

6. The upright type vacuum cleaner according to claim 5, wherein each of the roller members is configured in the shape of a hemisphere, one side of which is open, and each of the roller members has a hollow type boss provided therein, the first rotation shafts being coupled to the respective bosses.

7. The upright type vacuum cleaner according to claim 1, wherein the main body is provided at each side thereof with a coupling shaft to which the support part is rotatably coupled, and the upright type vacuum cleaner further comprises a second elastic member disposed between the support part and the coupling shaft to provide elastic force to the support part so that the support unit is moved from the operating position to the initial position.

8. The upright type vacuum cleaner according to claim 7, wherein the second elastic member comprises a torsion spring.

9. An upright type vacuum cleaner comprising:

a main body provided so that a disposition angle of the main body with respect to a surface to be cleaned is variable;

a suction nozzle coupled to the main body so that the suction nozzle moves along the surface to be cleaned; and a support unit rotatably provided at opposite sides of the main body to support the main body, wherein the support unit comprises:

a support part rotatably coupled to each side of the main body; and a wheel part provided at one end of the support part and coupled rotatably to the support part about a plurality of axes, wherein the support parts move the wheel parts farther relative to the suction nozzle when the cleaner is moved from a parked position to an operating position, wherein the wheel part comprises:

a frame member having first rotation shafts provided at opposite sides thereof and a second rotation shaft provided at an upper part thereof, the second rotation shaft being rotatably coupled to one end of the support part; and roller members rotatably coupled to the first rotation shafts, respectively.

10. The upright type vacuum cleaner according to claim 9, further comprising a joint provided between the main body and the suction nozzle to rotatably connect the main body and the suction nozzle so that the main body and the suction nozzle are rotated relative to each other about a plurality of axes, wherein the joint comprises:

a first joint member coupled to a first connection part provided at a lower part of the main body so that the main body is rotated about a first axis about which the main body is rotated to the left and to the right; and a second joint member provided at one side of the first joint member, the second joint member being coupled to a second connection part provided at the suction nozzle so that the main body is rotated about a second axis, perpendicular to the first axis, about which the main body is rotated upward and downward.

11. The upright type vacuum cleaner according to claim 10, wherein the first connection part is configured in a cylindrical shape, the first joint member is coupled to the first connection part in such a manner that the first joint surrounds the first connection part, the first joint being configured in a cylindrical shape corresponding to the shape of the first connection part, and the second joint member is coupled to the second connection part provided at the suction nozzle so that the second connection part is fixedly inserted into the second joint member.

12. The upright type vacuum cleaner according to claim 9, further comprising:

a support protrusion provided at each side of the main body, the support protrusion being inserted into the support unit to restrict rotation of the support unit so that the support unit is prevented from being rotated a predetermined angle or more.

13. The upright type vacuum cleaner according to claim 12, wherein the support unit further comprises:

an insertion groove formed at the support part so that the support protrusion is inserted into the insertion groove.

14. The upright type vacuum cleaner according to claim 13, further comprising:

a first elastic member disposed in the insertion groove so that the support part and the support protrusion are elastically supported therebetween; and a second elastic member disposed at a coupling shaft of the main body and the support unit to guide the support unit so that the support unit returns to an initial position, wherein the first elastic member comprises a compression spring, and the second elastic member comprises a torsion spring.

* * * * *